US005233340A

United States Patent [19]

Yamaguchi et al.

[11] Patent Number: 5,233,340

[45] Date of Patent: Aug. 3, 1993

[54] METHOD OF DRIVING A DISPLAY DEVICE

[75] Inventors: Hisashi Yamaguchi, Yamatokoriyama; Atsushi Sakamoto; Kazuo Shoji, both of Nara; Kioichi Yamamoto, Yamatokoriyama; Toshihiro Ohba, Nara; Hisashi Uede, Wakayama, all of Japan

[73] Assignee: Sharp Kabushiki Kaisha, Osaka, Japan

[21] Appl. No.: 900,754

[22] Filed: Jun. 19, 1992

Related U.S. Application Data

[63] Continuation of Ser. No. 579,733, Sep. 10, 1990, abandoned.

[30] Foreign Application Priority Data

Sep. 16, 1989 [JP] Japan ..... 1-240395

[51] Int. Cl.[5] ..... G09G 3/00

[52] U.S. Cl. ..... 340/793; 340/781

[58] Field of Search ..... 340/793, 781, 767, 805, 340/811, 825.81; 315/169.3

[56] References Cited

U.S. PATENT DOCUMENTS

| | | | |
|---|---|---|---|
| 4,488,150 | 12/1984 | Kanatani | 340/781 |
| 4,554,539 | 11/1985 | Graves | 340/793 |
| 4,559,535 | 12/1985 | Watkins et al. | 340/793 |
| 4,801,920 | 1/1989 | Ohba et al. | 340/781 |
| 4,827,255 | 5/1989 | Ishii | 340/793 |
| 4,888,523 | 12/1989 | Shoji et al. | 315/169.3 |

FOREIGN PATENT DOCUMENTS

| | | |
|---|---|---|
| 0254805 | 2/1988 | European Pat. Off. . |
| 0260146 | 3/1988 | European Pat. Off. . |
| 2164190 | 3/1986 | United Kingdom . |
| 2186730 | 8/1987 | United Kingdom . |

*Primary Examiner*—Alvin E. Oberley
*Assistant Examiner*—Xiao M. Wu
*Attorney, Agent, or Firm*—Nixon & Vanderhye

[57] ABSTRACT

A method of driving a display device with a plurality of scanning side electrodes and a plurality of data side electrodes which are disposed in directions intersecting each other, and a dielectric layer interposed between the scanning side electrodes and the data side electrodes, and including steps of applying modulation voltages corresponding to display data to the data side electrodes, and also applying writing voltages of positive or negative polarity to the scanning side electrodes through line sequence, so as to cause picture elements composed of the dielectric layer to emit light. The driving method further includes steps of thinning out the display data, and applying a plurality of kinds of modulation voltages different in amplitude according to each frame, so as to cause the picture elements to effect gradation display of different brightness in multi-stages.

5 Claims, 7 Drawing Sheets

(1) Scanning side impression waveform (2) Data side impression waveform (3) Effective voltage waveform (Total light emission · non-light emission)

(4) Effective voltage waveform (Brightness level 2)

(5) Effective voltage waveform (Brightness level 1)

METHOD OF DRIVING A DISPLAY DEVICE

This is a continuation of application Ser. No. 07/579,733, filed Sep. 10, 1990, now abandoned.

BACKGROUND OF THE INVENTION

The present invention generally relates to a display device and more particularly, to a method of driving a display device, for example, a capacitive flat matrix display panel (referred to as a thin film EL display device hereinafter), etc.

FIG. 8 is a block diagram showing overall construction of a conventional thin film EL display device, which generally includes a display panel 1, a data side switching circuit 2, a scanning side switching circuit 5, a drive circuit 8, and a drive logic circuit 11 coupled to each other as illustrated.

In the known arrangement of FIG. 8, the display panel 1 is composed of a thin film EL element. In the case where this thin film EL element is, for example, of a double insulated type thin film EL element, it includes belt-like transparent electrodes arranged in a parallel relation on a glass substrate, a dielectric substance applied thereover, an EL layer further applied thereover, and another dielectric substance further applied thereon to provide a three-layered structure, and belt-like back electrodes further applied thereover so as to extend parallely in a direction intersecting at right angles with said transparent electrodes referred to above.

In the display panel 1 as described above, the transparent electrodes of the thin film EL element are set to be the data side electrodes x1 to x8, while the back electrodes of said thin film EL element are adapted to be the scanning side electrodes y1 to y4.

The data side switching circuit 2 is intended to apply OV or $V_M$ as a modulation voltage individually to the respective data side electrodes x1 to x8, and includes a group of data side output ports 3 individually connected to the respective data side electrodes x1 to x8, and a logic circuit 4 which receives display data corresponding t the respective data side electrodes x1 to x8 so as to turn on or off the data side output ports 3 according to said display data.

Meanwhile, the scanning side switching circuit 5 is a circuit for impressing Vw1 or −Vw2 (in a relation $Vw1=Vw2+V_M$, and represented as $Vw1 \geqq Vth$, $Vw2 \leqq Vth$ when light emitting threshold voltage of the thin film EL element is denoted by Vth) to the respective scanning side electrodes y1 to y4 according to the line sequence thereof as a writing voltage, and includes a group of scanning side output ports 6 individually connected to the respective scanning side electrodes y1 to y4, and a logic circuit 7 for turning on or off the group of the scanning side output ports 6 according to the line sequence of the scanning side electrodes y1 to y4.

The drive circuit 8 is arranged to generate a high voltage for driving the display panel 1 from a predetermined constant reference voltage $V_D$, and is provided with a modulation drive circuit 9 for supplying modulation voltage Vm to the data side output ports 3, and a write drive circuit 10 for supplying write voltages Vw1 and −Vw2 to the scanning side output ports 6.

The drive logic circuit 11 is a circuit for generating various timing signals necessary for driving the display panel 1, based on input signals such as a display data signal D, a data transfer clock CK, a horizontal synchronizing signal H, and a vertical synchronizing signal V, etc.

The fundamental driving for the display of the thin film EL display device as described above is effected by applying OV or $V_M$ to the data side electrodes x1 to x8 as modulation voltages corresponding to the display data which determine light emission or non-light emission, with a section extending over first and second two frames being set as one period, and also, by applying the write voltage Vw1 to the scanning side electrodes y1 to y4 at the first frame, and the write voltage, −Vw2 thereto at the second frame by line sequence.

By the above display function, a superposing effect or offset effect of the write voltage Vw1 or −Vw2 and the modulation voltage OV or $V_M$ is produced at the portions of picture elements where the data side electrodes x1 to x8 and the scanning side electrodes y1 to y4 intersect each other, and a voltage Vw1 higher than a light emitting threshold voltage Vth or a voltage Vw2 lower than the light emitting threshold voltage Vth is applied to each picture element as an effective voltage, whereby the respective picture elements are brought into the light emitting state or non-light emitting state to provide the predetermined display. Accordingly, with respect to one image element, effective voltage inverted in its polarity between the first frame and the second frame respectively is alternately impressed, and thus, with the two frames set as one period, symmetrical A.C. driving ideal for a thin film EL element is to be effected.

Conventionally, in the thin film EL display device as described above, as a driving method for varying brightness of the respective picture elements in a plurality of stages, i.e. for effecting gradation display, there have been known an amplitude control system for controlling amplitude of the modulation voltage $V_M$ to be impressed to the data side electrodes x1 to x8, a pulse width modulation system for varying pulse width of the modulation voltage $V_M$, and a frequency modulation system for thinning out the display data of either the first frame or second frame.

However, in the driving methods of the amplitude modulation system or pulse width modulation system as described above, there has been for that a problem that, if it is intended to increase the number of stages in the gradation, the amplitude or pulse width of the modulation voltage $V_M$ must be controlled very finely during one scanning period, and in order to effect such a control at a high accuracy, circuit construction is undesirably complicated, thus resulting in cost rise.

Furthermore, when the gradation display is to be effected by the driving method of the known frequency modulation system as referred to above, there has also been such a disadvantage that, in the case where the display data is cut in the first frame or in the second frame, the effective voltages to be applied to the picture element is the same in the one period consisting of the first frame and second frame, and as a result, all, the gradations which can be displayed are limited only to three gradations namely, light emission, non-light emission and intermediate tone, and also with limitation to the increase in the number of stages for the gradations.

SUMMARY OF THE INVENTION

Accordingly, an essential object of the present invention is to provide a driving method of a display device, which is so arranged that the number of stages for gradation display may be increased through a simple circuit construction.

Another object of the present invention is to provide a driving method of a driving device of the above described type, which may be readily effected by the driving device with simple construction.

In accomplishing these and other objects, according to one preferred embodiment of the present invention, there is provided a method of driving a display device with a plurality of scanning side electrodes (y1 to y4) and a plurality of data side electrodes (x1 to x8) which are disposed in directions intersecting each other, and a dielectric layer means interposed between said scanning side electrodes and said data side electrodes, and including steps of applying modulation voltages corresponding to display data to said data side electrodes, and also applying writing voltages of positive or negative nature to said scanning side electrodes through line sequence, so as to cause picture elements composed of said dielectric layer means to emit light.

The driving method further comprises steps of thinning out the display data, and applying a plurality of kinds of modulation voltages different in amplitude for each frame, thereby causing the picture elements to effect gradation display of different brightness in multistages.

In the method of the present invention as described above, since the amplitude of the modulation voltage differs for each frame, brightness of the intermediate tone to be displayed also differs according to the different frame to be cut in the display data, thus making it possible to effect gradation display in more than three stages.

BRIEF DESCRIPTION OF THE DRAWINGS

These and other objects and features of the present invention will become apparent from the following description taken in conjunction with the preferred embodiment thereof with reference to the accompanying drawings, in which;

FIG. 1 is a block diagram showing general construction of a thin film EL display device to which a driving method according to one preferred embodiment of the present invention may be applied.

DETAILED DESCRIPTION OF THE INVENTION

Figure 8:
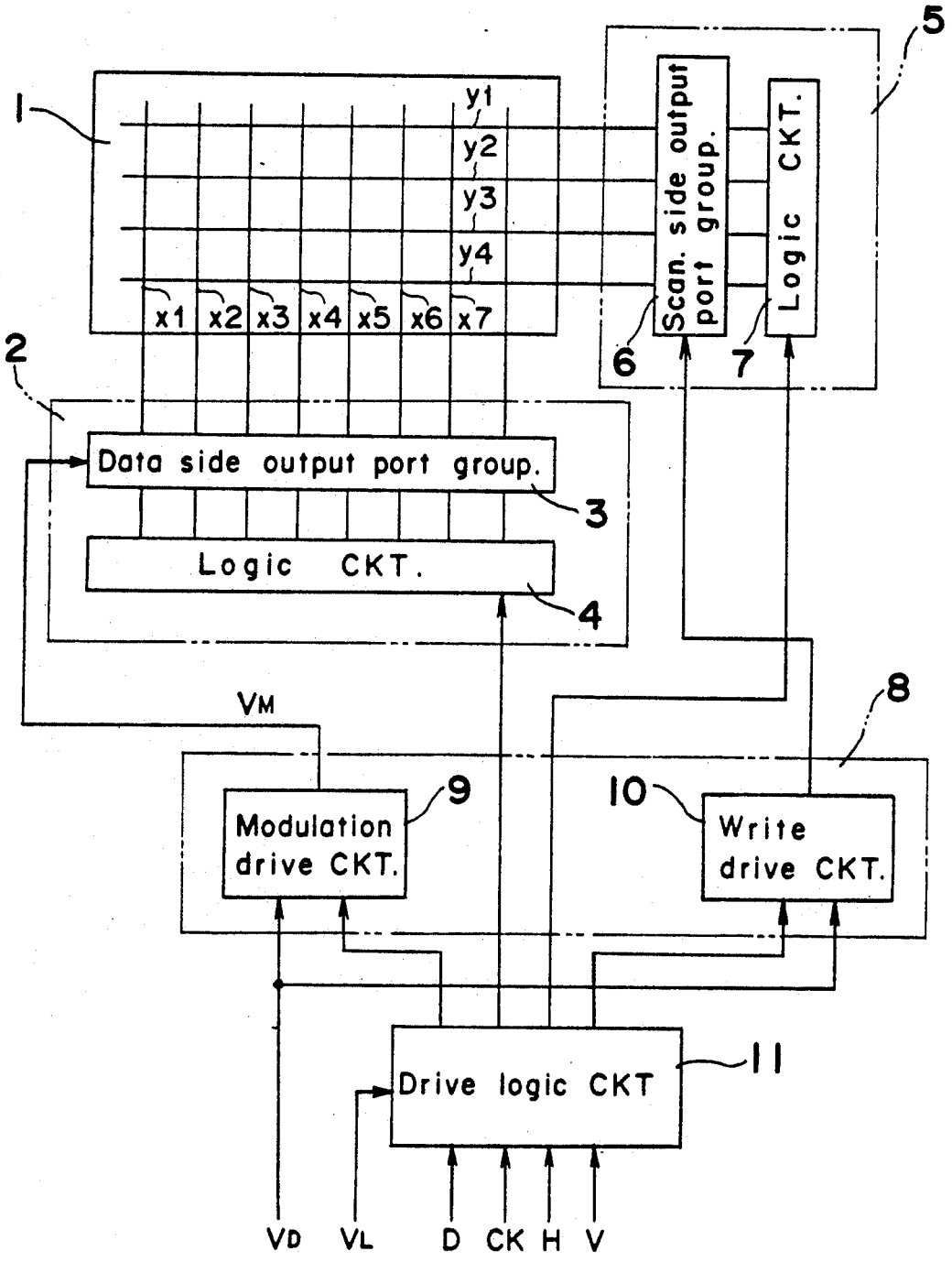
Fig. 8 PRIOR ART
FIG. 8 is a block diagram showing general construction of a thin film EL display device to which a conventional driving method is applied (already referred to).

Before the description of the present invention proceeds, it is to be noted that like parts are designated by like reference numerals throughout the accompanying drawings.

Referring now to the drawings, there is shown in FIG. 1, a block diagram showing general construction of a thin film EL display device E to which a driving method according to one preferred embodiment of the present invention may be applied.

As shown in FIG. 1, the thin film EL display device E has the construction generally similar to the thin film EL display device as described earlier with reference to FIG. 8 for the conventional driving method, and includes a display panel 21, a data side switching circuit 22, a scanning side switching circuit 25, a drive circuit 28, and a drive logic circuit 31 as described hereinafter.

In FIG. 1, the display panel 21 is composed of a double insulated type thin film EL element, and includes belt-like transparent electrodes arranged in a parallel relation on a glass substrate, a dielectric substance applied thereover, an El layer further applied thereover, and another dielectric substance further applied thereon to form a three-layered structure, and belt-like back electrodes further applied thereover so as to extend parallely in a direction intersecting at right angles with said transparent electrodes.

In the display panel 21 as described above, the transparent electrodes of the thin film EL element are set to be the data side electrodes x1 to x8, while the back electrodes of said thin film EL element are adapted to be the scanning side electrodes y1 to y4.

The data side switching circuit 22 is a circuit intended to apply OV, $1/2V_M$ or $V_M$ as a modulation voltage individually to the respective data side electrodes x1 to x8, and includes a group of data side output ports 23 individually connected to the respective data side electrodes x1 to x8, and a logic circuit 24 which receives display data D corresponding t the respective data side electrodes x1 to x8 so as to turn on or off the data side output ports 23 according to said display data D.

Meanwhile, the scanning side switching circuit 25 is a circuit for impressing Vw1 or $-$Vw2 (in a relation $Vw1=Vw2+V_M$, and represented as $Vw1 \geqq Vth$, $Vw2 \leqq Vth$) to the respective scanning side electrodes y1 to y4 according to the line sequence thereof as a writing voltage, and includes a group of scanning side output ports 26 individually connected to the respective scanning side electrodes y1 to y4, and a logic circuit 27 for turning on or off the group of the scanning side output ports 26 according to the line sequence of the scanning side electrodes y1 to y4.

The drive circuit 28 is arranged to generate a high voltage for driving the display panel 21 from a predetermined constant reference voltage $V_D$, and is provided with a modulation drive circuit 29 for supplying a modulation voltage $1/2V_M$ and $V_M$ to the data side output ports 23, and a write drive circuit 30 for supplying write voltages Vw1 and $-$Vw2 to the scanning side output port 26.

The drive logic circuit 31 is a circuit for generating various timing signals necessary for driving the display panel 21, based on input signals such as display data signals [D1,DO] of 2 bits, a data transfer clock CK, a horizontal synchronizing signal H, and a vertical synchronizing signal V, etc., and includes therein a data processing circuit 32 for processing the above described 2 bit display data signals [D1, DO]. These 2 bit display data signals [D1,DO] are arranged to correspond so as to designate brightness levels in four gradations as shown in Table 1 below.

Figure 2:
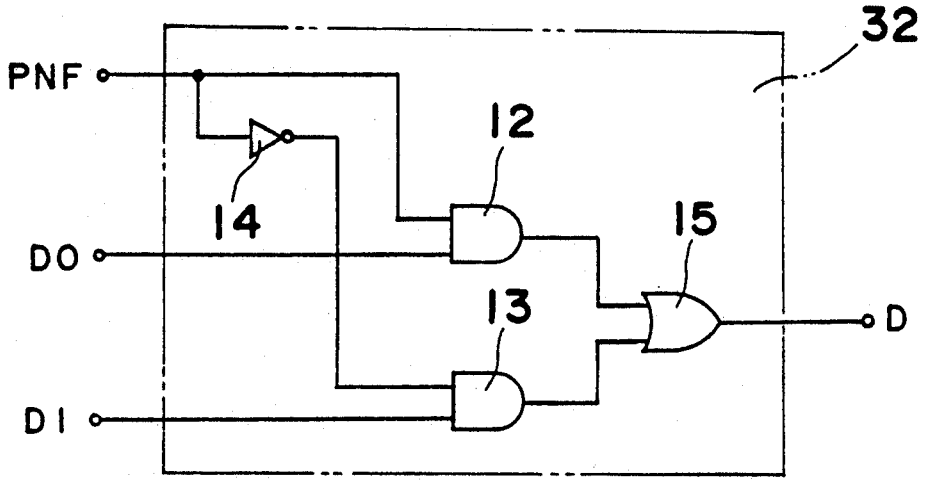
FIG. 2 is a block diagram showing construction of a data signal processing circuit included in a drive logic circuit of the thin film EL display circuit of FIG. 1.

Referring also to FIG. 2, there is shown circuit construction of the data signal processing circuit 32 referred to above, which includes an AND gate 12 having as two inputs, the lower order bit signal DO of the display data signals [D1, DO] and a frame inversion signal PNF, another AND gate 13 having as two inputs, the higher order bit signal D1 of the display data signal [D1,DO] and signal in which the frame inversion signal PNF is inverted by an invertor 14, and an OR gate 15 connected to outputs of said AND gates 12 and 13 as two inputs, with the output of said OR gate 15 being applied, as the display data D, to the logic circuit 24 of the data side switching circuit 22 of FIG. 1. Here, one period for driving is set to include the first frame and second frame, and the above frame inversion signal PNF is applied as the signal which assumes a high level (referred to as H level hereinafter) in the first frame, and a low level (referred to as L level hereinafter) in the second frame.

TABLE 1

| | Brightness | | | |
|---|---|---|---|---|
| | Display data | | 1st frame Display D | 2nd frame Display D |
| level | D0 | D1 | data | data |
| 0 (non-light emission) | L | L | L | L |
| 1 | L | H | L | H |
| 2 | H | L | H | L |
| 3 (Total light emission) | H | H | H | H |

Figure 3:
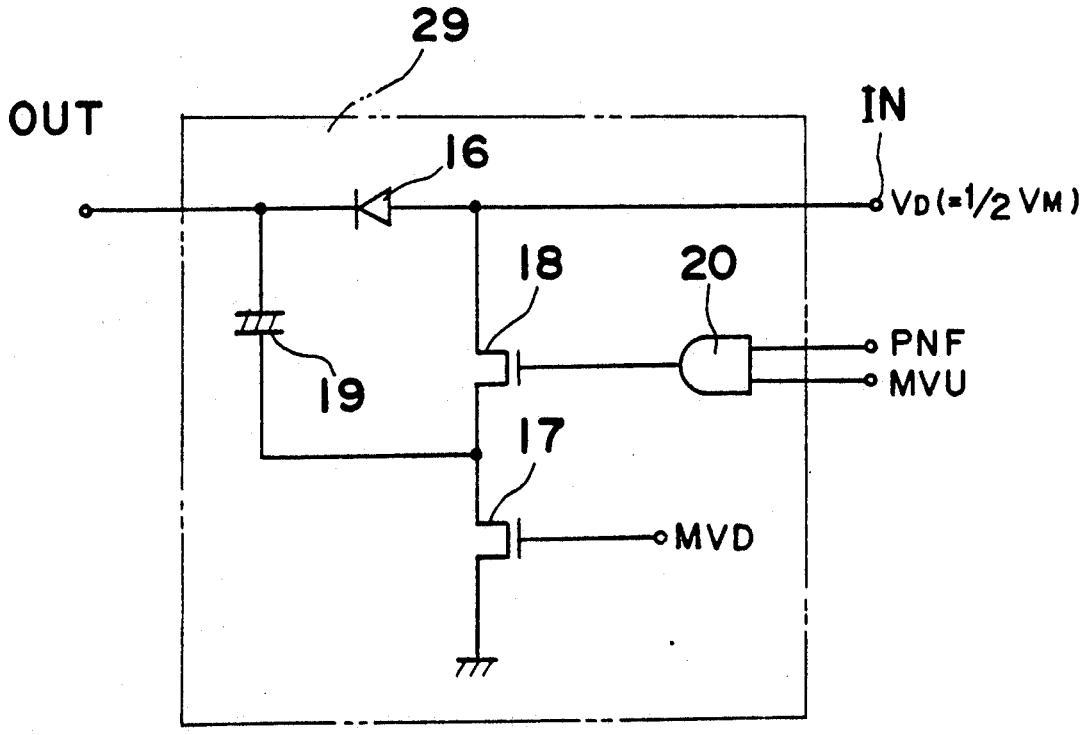
FIG. 3 is also a block diagram showing construction of a modulation drive circuit of the thin film EL display device of FIG. 1, FIGS. 4(1)-(5) is a timing chart showing four gradation display driving of any desired picture elements for the thin film EL display device of FIG. 1, FIGS. 5(1)-(5) is a timing chart showing functioning of the modulation drive circuit in the four gradation display driving, FIGS. 6(1)-(5) is also a timing chart showing three gradation display driving of any desired picture elements for the thin film EL display device of FIG. 1, FIGS. 7(1)-(3) is a timing chart showing functioning of the modulation drive circuit in the three gradation display driving.

Referring further to FIG. 3 showing circuit construction of a modulation voltage generating function section of the modulation drive circuit 29 referred to earlier, the input terminal IN of the reference voltage $V_D(=1/2V_M)$ is connected to the output terminal OUT through a diode 16, with two transistors 17 and 18 being connected in series between the input terminal IN and ground. Moreover, between a junction of the two transistors 17 and 18 and the output terminal OUT, a capacitor 19 is connected. To the gate of the transistor 17, a signal MVD for on/off control of said transistor is applied, while, to the gate of the other transistor 18, a signal MVU for on/off control thereof is applied through an AND gate 20, with a PNF signal being applied to the AND gate 20 as the other input thereof. The signals MVD and MVU are each pulses having one scanning period as a cycle.

Figure 4:
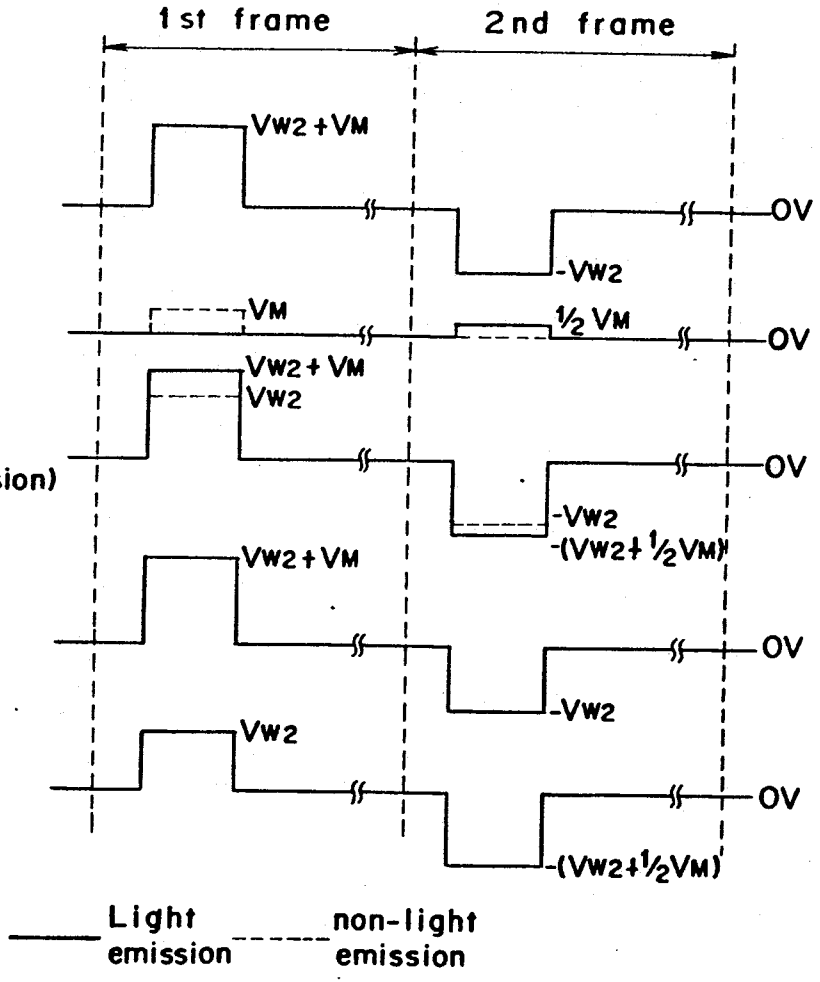

FIG. 4 is a timing chart showing driving of any desired picture elements for the thin film EL display device of FIG. 1, in which FIG. 4-(1) shows the waveform diagram of writing voltage to be applied to the scanning side electrodes, FIG. 4-(2) represents the waveform diagram of modulation voltage to be applied to the data side electrodes, FIG. 4-(3) indicates the waveform diagram of effective voltage of the display of brightness levels at 0 and 3, FIG. 4-(4) denotes the waveform diagram of effective voltage during driving of the display of brightness level 2 (i.e. higher side brightness of the intermediate tone), and FIG. 4-(5) shows the waveform diagram of effective voltage during driving of the display of brightness level 1 (i.e. lower side brightness of the intermediate tone).

Figure 5:
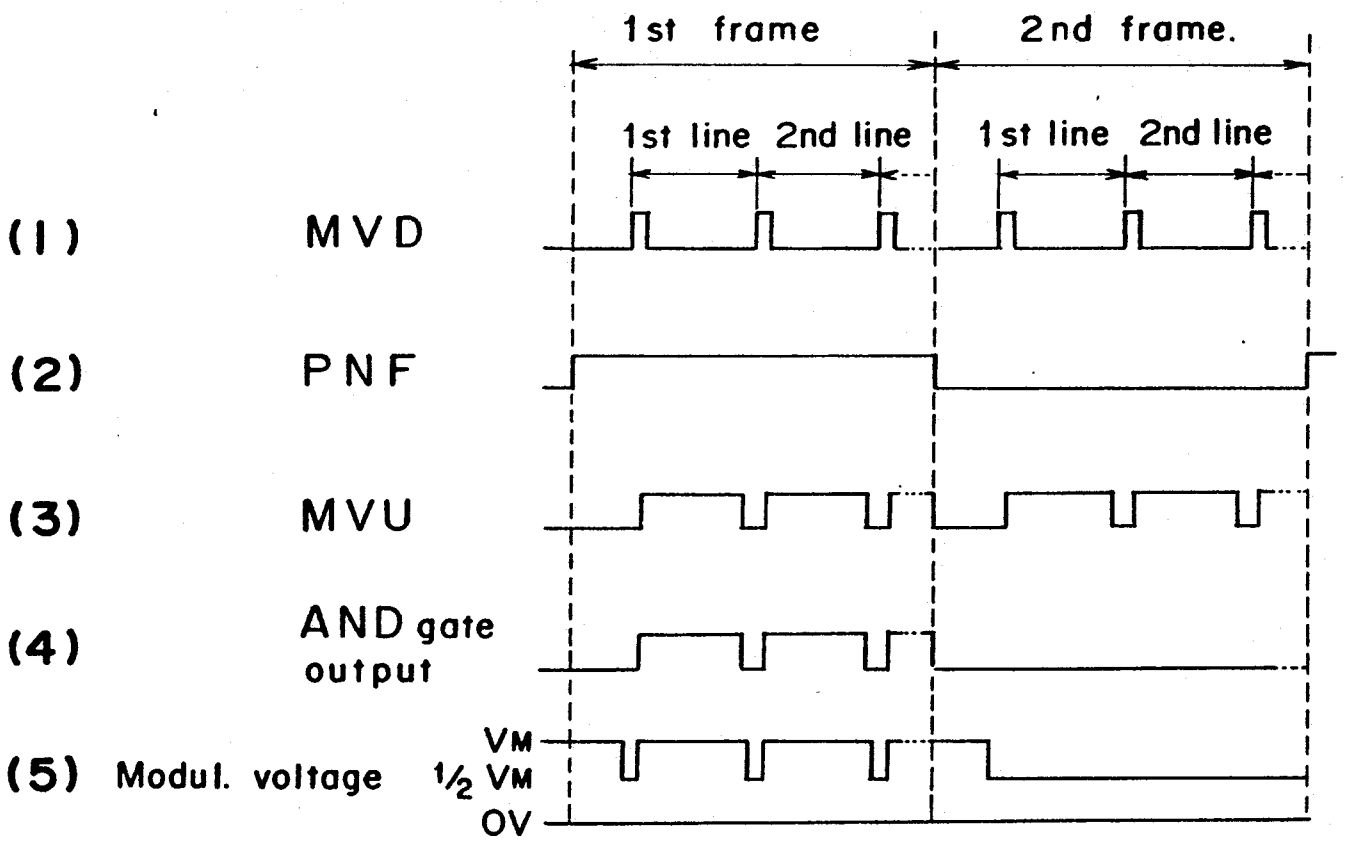

Meanwhile, FIG. 5 is a timing chart representing driving of the modulation driving circuit 29 referred to earlier, in which FIG. 5-(1) shows the waveform diagram for the MVD signal, FIG. 5-(2) denotes the waveform diagram for the PNF signal, FIG. 5-(3) represents the waveform diagram for the MVU signal, FIG. 5-(4) indicates the waveform diagram of the output signal of the AND gate 20, and FIG. 5-(5) shows the waveform diagram of the modulation voltage to be outputted from the modulation drive circuit 29 respectively.

Subsequently, functioning for the four gradation display driving by the thin film EL display device of FIG. 1 will be described with reference to the timing charts of FIGS. 4 and 5.

As shown in FIG. 4-(1), in the scanning side electrodes y1 to y4, according to the line sequence thereof, the writing voltage $Vw1 (=Vw2+V_M)$ is impressed in the first frame, while the writing voltage $-Vw2$ is applied in the second frame.

On the other hand, in the data side electrodes x1 to x8, according to the display data D, OV or $V_M$ is applied as the modulation voltage in the first frame, while OV or ½m is impressed in the second frame. The modulation voltage $V_M$ in the first frame, and the modulation voltage $1/2V_M$ in the second frame are supplied from the modulation drive circuit 29 in the manner as described hereinafter.

As shown in FIG. 5-(1), in a short period at the beginning of each scanning period, the MVD signal becomes "High" to turn on the transistor 17, and therefore, the capacitor 19 is charged by an amount equivalent to $1/2V_M$ (FIG. 3). In the remaining whole period of the scanning period subsequent thereto, the MVD signal becomes "Low", while the MVU signal becomes "High" as shown in FIG. 5-(3). Accordingly, in the first frame in which the PNF signal assumes "High" as shown in FIG. 5-(2), the output of the AND gate 20 becomes "High" as shown in FIG. 5-(4), and the transistor 18 is turned on, with the potential of the capacitor 19 at the side of the junction between the transistors 17 and 18 becomes $1/2\ V_M$, and at this time, the output of the modulation drive circuit 29 becomes $V_M$ as represented in FIG. 5-(5).

Meanwhile, as shown in FIG. 5-(2), in the second frame in which the PNF signal becomes "Low", the output of the AND gate 20 becomes "Low" as in FIG. 5-(4) irrespective of the MVU signal, with the transistor 18 held in the off state, and therefore, the output of the modulation drive circuit 29 becomes $1/2\ V_M$ as illustrated in FIG. 5-(5).

Furthermore, in the data signal processing circuit 32 of the drive logic circuit 31, the 2 bit display data signal [D1,DO] to be inputted is converted into the 1 bit display data D in the manner as described hereinbelow.

In the first place, in the case where the display data signals [D1,DO] are of [L,L] equivalent to the brightness level 0 (non-light emission), both of the outputs of the AND gates 12 and 13 (FIG. 2) become "Low" level, and thus, the output of the OR gate 15, i.e. the display data D becomes "Low" level as shown in Table 1 both in the first frame and second frame. In the case where the display data signals [D1,DO] are of [H,L] equivalent to the brightness level 1 (lower side brightness in the intermediate tone), the output of the AND gate 12 becomes "Low" level both in the first frame and the second frame, while the output of the AND gate 13 becomes "High" level only in the second frame, and accordingly, the display data D becomes "Low" level in the first frame, and "high" level in the second frame as shown in FIG. 1. When the display data signals [D1,DO] are of [L,H] corresponding to the brightness level 2 (i.e. higher side brightness of the intermediate tone), the output of the AND gate 12 becomes "High"

level only in the first frame, while output of the AND gate 13 becomes "Low" level both in the first frame and second frame, and accordingly, the display data D becomes "High" level in the first frame, and "Low" level in the second frame as shown in Table 1. In the case where the display data signals [D1,DO] are of [H,H] equivalent to the brightness level 3 (total light emission), the output of the AND gate 12 becomes "High" level only in the first frame, while the output of the AND gate 13 becomes "High" level only in the second frame, and accordingly, the display data D becomes "High" level both in the first and second frames as shown in Table 1.

In the logic circuit 24 of the data side switching circuit 22, on/off state of the group of data side output ports 23 is controlled according to the display data D. More specifically, in the first frame, when the display data D is of "High" level, OV is selected as the modulation voltage to be applied to the data side electrodes x1 to x8 (shown in the solid line in FIG. 4-(2)), and when the display data D is of "Low" level, $V_M$ is selected as the modulation voltage (shown in the dotted line in FIG. 4-(2)).

On the other hand, in the second frame, when the display data D is of "High" level, $1/2V_M$ is selected as the modulation voltage (shown in the solid line in FIG. 4-(2)), and when the display data D is of "Low" level, OV is selected as the modulation voltage (shown in the dotted line in FIG. 4(2)).

The modulation voltage corresponding to the case where the display data D shown in the dotted line in FIG. 4-(2) is of "Low" level, is a modulation voltage which acts to offset the writing voltages Vw1 and −Vw2 shown in FIG. 4-(1), and corresponds to the non-light emission in the case of 01 display (two stage display for light emission or non-light emission). Conversely, the modulation voltage corresponding to the case where the display data D shown in the solid line in FIG. 4-(2) is of "High" level, is a modulation voltage which acts to be superposed on the writing voltages Vw1 and −Vw2, and corresponds to the light emission in the case of 01 display.

The effective voltage to be applied to the picture elements is equivalent to the difference between the writing voltages Vw1 and −Vw2 (FIG. 4-(1)) to be applied to the scanning side electrodes corresponding to the picture elements and the modulation voltages OV, $1/2V_M$ and $V_M$ to be applied to the data side electrodes corresponding to said picture elements, and represented by the waveform shown in FIG. 4-(3). In FIG. 4-(3), the polarities of the effective voltage are given based on the data side electrodes as the reference). In other words, in FIG. 4-(3), the solid line represents the case of the brightness level 3 (total light emission), while the dotted line shows the case of the brightness level 0 (non-light emission).

As described so far, in the case of the display of the brightness level 2, the display data D is of "High" level in the first frame (accordingly, the modulation voltage is OV), and "Low" level in the second frame (accordingly, the modulation voltage is OV), and therefore, the effective voltage to applied to the picture elements becomes a voltage Vw1 ($=Vw2+V_M$) corresponding to the total light emission in the first frame, and a voltage −Vw2 corresponding to the non-light emission in the second frame as shown in FIG. 4-(4). In other words, display driving equivalent to that in which the display data signals [D1,DO] for the total light emission are cut at the second frame, is to be effected.

Meanwhile, in the case of the display for the brightness level 1, the display data D is of "Low" level (accordingly, the modulation voltage is $V_M$) in the first frame, and is of "High" level (accordingly, the modulation voltage is $1/2V_M$) in the second frame, and therefore, the effective voltage becomes the voltage Vw2 corresponding to the non-light emission in the first frame, and the voltage $-(Vw2+1/2V_M)$ corresponding to the total light emission in the second frame as shown in FIG. 4-(5). In other words, display driving equal to that in which the display data signals [D1,D0] for the total light emission are cut in the first frame, is to be effected.

As is seen from the comparison between FIG. 4-(4) and FIG. 4-(5), the effective voltage to be impressed to the picture elements in one period in which the first and second frames are combined, becomes larger in the case of the display for the brightness level 2 than in the case of the display for the brightness level 1. In other words, the intermediate tone is to be displayed in two stages, thus effecting the display in four gradations on the whole.

It should be noted here that in the foregoing embodiment, although the description has been given with respect to the case where the display in four gradations are effected through employment of the thin film EL display device, with the intermediate tone divided into two stages, the present invention is not limited in its application to the above alone, but may be so modified, for example, as to effect the display in three stages of non-light emission, intermediate tone, and total light emission through employment of the same display device.

Figure 6:
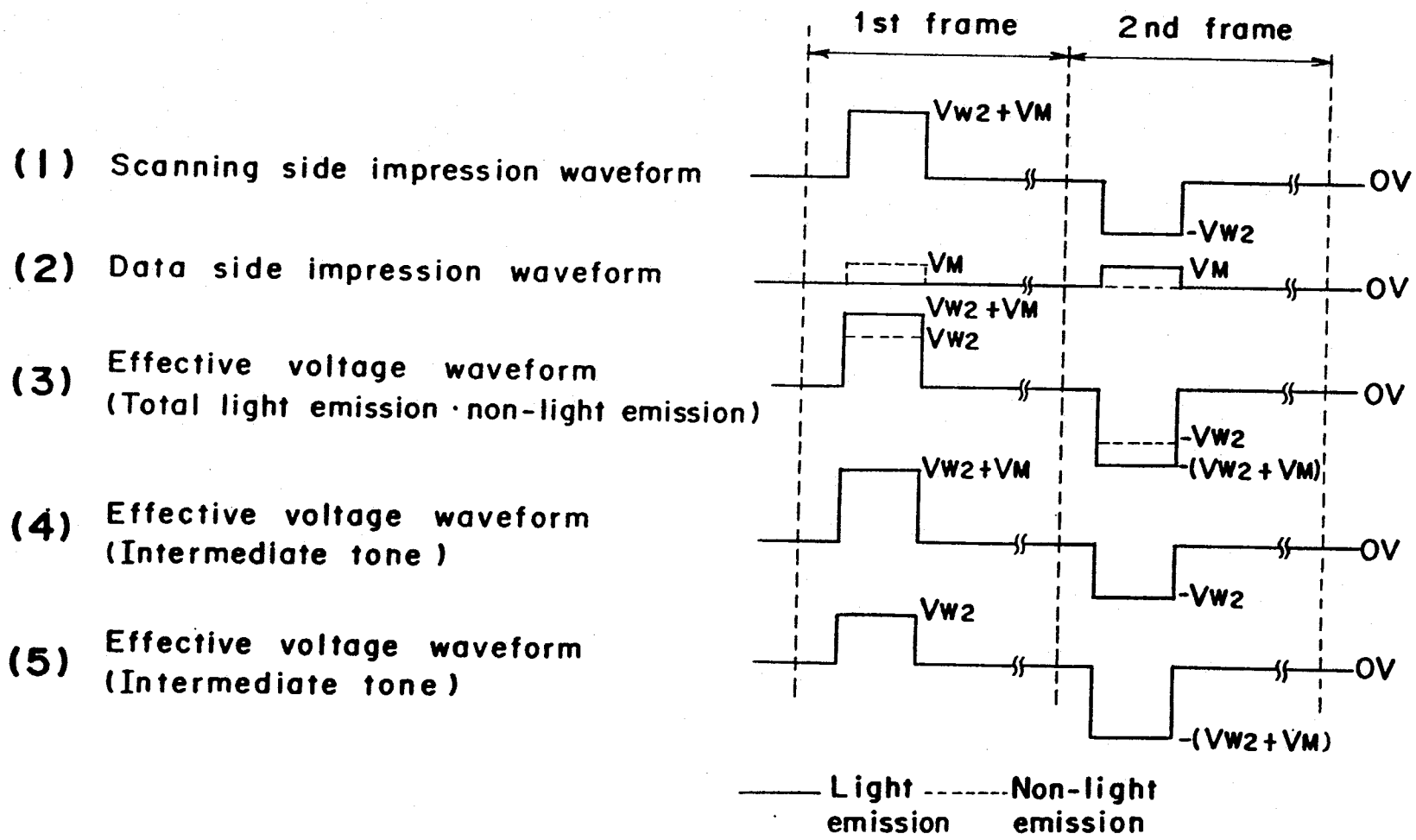

FIG. 6 is a timing chart showing driving of any desired picture element in the case of the display of the three gradations referred to above, in which FIG. 6-(1) shows the waveform diagram of writing voltage to be applied to the scanning side electrodes, FIG. 6-(2) represents the waveform diagram of modulation voltage to be applied to the data side electrodes, FIG. 6-(3) indicates the waveform diagram of effective voltage to be applied to the picture elements during driving of the display for the non-light emission and total light emission, FIGS. 6-(4) and 6-(5) denote the waveform diagrams of effective voltages during driving of the display of the intermediate tone.

Figure 7:
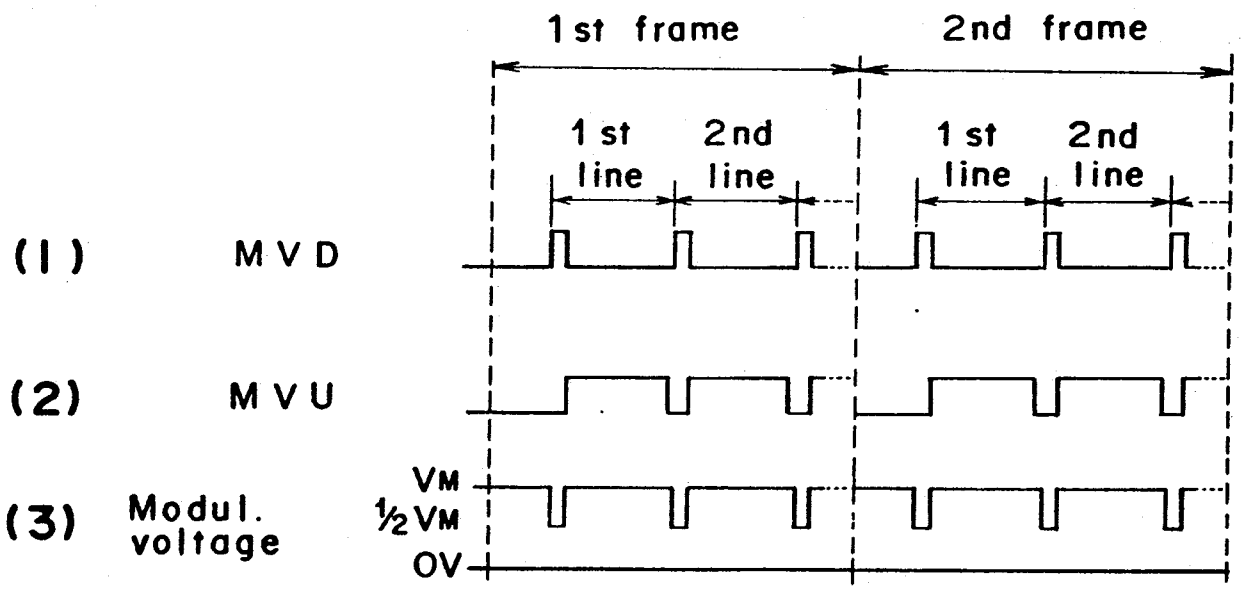
Figure 8:
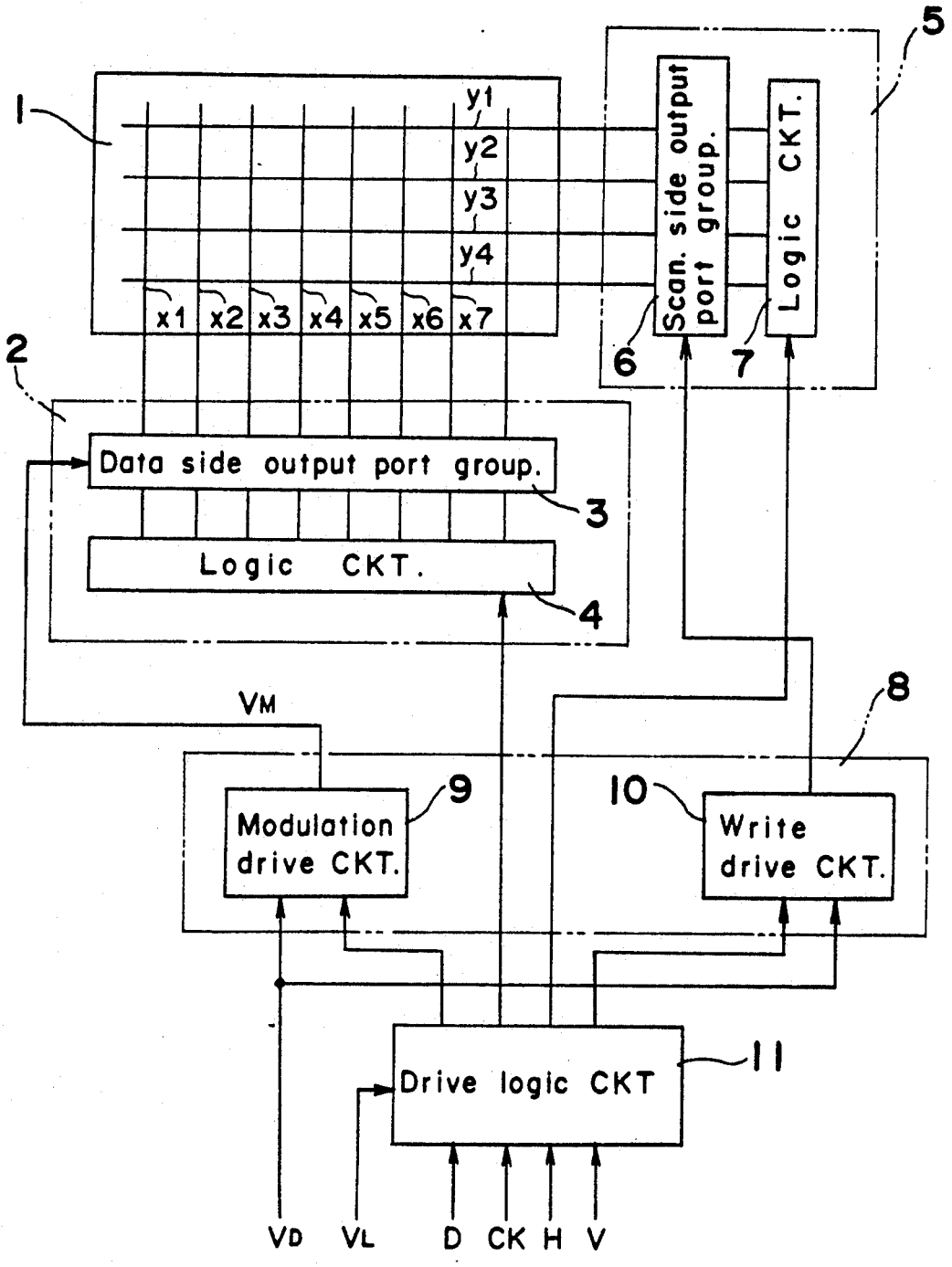
Fig. 8 PRIOR ART

Meanwhile, FIG. 7 is a timing chart representing driving of the modulation driving circuit 29 in the case of the above three gradation display, in which FIG. 7-(1) shows the waveform diagram for the MVD signal, FIG. 7-(2) represents the waveform diagram for the MVU signal, and FIG. 7-(3) shows the waveform diagram of the modulation voltage to be outputted from the modulation drive circuit 29 respectively.

Subsequently, functioning for the three gradation display driving by the thin film EL display device of FIG. 1 will be generally described with reference to the timing charts of FIGS. 6 and 7.

As shown in FIG. 6-(1), in the scanning side electrodes y1 to y4, according to the line sequence thereof, the writing voltage Vw1 ($=Vw2+V_M$) is impressed in the first frame, while the writing voltage −Vw2 is applied in the second frame in the similar manner as in the four gradation display described earlier.

On the other hand, in the data side electrodes x1 to x8, according to the display data D, OV or $V_M$ is applied as the modulation voltage (similarly both in the first and second frames). This modulation voltage $V_M$ is supplied from the modulation drive circuit 29 in the manner as described hereinafter.

As shown in FIG. 7-(1), in a short period at the beginning of each scanning period, the MVD signal becomes "High level, and in the remaining whole period of the scanning period subsequent thereto, the MVU signal becomes "High" in the similar manner as in the four gradation display. Here, as one input of the AND gate 20, instead of the PNF signal, the signal assuming "High" level all through the first and second frames is applied. Accordingly, the output of the AND gate 20 becomes equal to the MVU signal through the first and second frames, and the transistor 18 is turned on per each scanning period in any of the frames, and thus, one kind of modulation voltage $V_M$ is outputted from the modulation drive circuit 29 per each scanning period as shown in FIG. 7-(3).

Meanwhile, in the data signal processing circuit 32 of the drive logic circuit 31, data conversion processing similar to that in the four gradation display as referred to earlier is effected. In this case, the display data signals [D1,DO] are set to either of the state of brightness level 1 or 2 in the case of the four gradation display, as the signals corresponding to the intermediate tone (Any of such states is acceptable).

In the logic circuit 24 of the data side switching circuit 22, on/off state of the group of data side output ports 23 is controlled in the similar manner as in the four gradation display according to the display data D applied from the data signal processing circuit 32. More specifically, in the first frame, when the display data D is of "High" level, OV is selected as the modulation voltage to be applied to the data side electrodes x1 to x8 (shown in the solid line in FIG. 6-(2)), and when the display data D is of "Low" level, $V_M$ is selected as the modulation voltage (shown in the dotted line in FIG. 6-(2)).

On the other hand, in the second frame, when the display data D is of "High" level, $V_M$ is selected as the modulation voltage (shown in the solid line in FIG. 6-(2)), and when the display data D is of "Low" level, OV is selected as the modulation voltage (shown in the dotted line in FIG. 6-(2)).

In the above case, the effective voltage to be impressed to the picture elements takes the form as shown in the solid line in FIG. 6-(3) (corresponding to the modulation voltage shown in the solid line in FIG. 6-(2)) in the case of the total light emission display, while it takes the form as shown in the dotted line in FIG. 6-(3) (corresponding to the modulation voltage shown in the dotted line in FIG. 6-(2)) in the case of non-light emission display. Meanwhile, when the display data signals [D1,DO] are set in the state of brightness level 2 in the four gradation display, the display data D is of "High" level in the first frame (accordingly, the modulation voltage is OV), and of "Low" level in the second frame (accordingly, the modulation voltage is OV), and therefore, the effective voltage to be applied to the picture elements becomes the voltage Vw1 ($=Vw2+V_M$) corresponding to the total light emission in the first frame, and the voltage $-Vw2$ corresponding to the non-light emission in the second frame as shown in FIG. 6-(4). In other words, display driving equivalent to that in which the display data signals [D1,DO] for the whole light emission are cut at the second frame, is to be effected.

On the other hand, when the display data signals [D1,DO] are set in the state of the brightness level 1 in the four gradation display for the intermediate tone display, contrary to the above case, the display data D is of "Low" level (accordingly, the modulation voltage is $V_M$) in the first frame, and is of "High" level (accordingly, the modulation voltage is $V_M$) in the second frame, and therefore, the effective voltage becomes the voltage Vw2 corresponding to the non-light emission in the first frame, and the voltage $-Vw1(=-(Vw2+V_M))$ corresponding to the total light emission in the second frame as shown in FIG. 6-(5). In other words, display driving equal to that in which the display data signal [D1,DO] for the total light emission are cut in the first frame, is to be effected.

As is seen from the comparison between FIG. 6-(4) and FIG. 6-(5), the effective voltage to be impressed to the picture elements in one period in which the first and second frames are combined, becomes equal in any of the intermediate tone display, and thus, the three gradation display for the non-light emission, intermediate tone, and total light emission is to be effected.

It should be noted here that in the foregoing embodiment, although the driving method of the present invention is described with reference to the case of the gradation display by the thin film EL display device, the concept of the present invention is not limited in its application to such thin film EL display device alone, but may be readily applied to other display devices, for example, to a liquid crystal display device and the like as well.

As is clear from the foregoing description, in the driving method of the display device according to the present invention, since it is so arranged to thin out the display data, and also, to vary the amplitude of the modulation voltage for each frame, gradation display in more than three stages may be effected through a simple circuit construction.

Although the present invention has been fully described by way of example with reference to the accompanying drawings, it is to be noted here that various changes and modifications will be apparent to those skilled in the art. Therefore, unless other wise such changes and modifications depart from the scope of the present invention, they should be construed as included therein.

What is claimed is:

1. A method of driving a display device with a plurality of scanning side electrodes and a plurality of data side electrodes which are disposed in directions intersecting each other, and a dielectric layer means interposed between said scanning side electrodes and said data side electrode, and including steps of applying plural frames per drive cycle of modulation voltages corresponding to display data to said data side electrodes, and also applying plural frames per drive cycle of writing voltages of positive or negative polarity to said scanning side electrodes through line sequencing, so as to cause picture elements composed of said dielectric layer means to emit light in response to an applied voltage which is higher than a light emitting threshold voltage, said driving method further comprising steps of thinning out the display data by selecting the number of frames to be impressed in one drive cycle with the applied voltages higher than said threshold voltage, applying a plurality of kinds of modulation voltages which are different in amplitude in each frame, wherein said voltages applied to said picture elements are different in each frame when the number of frames selected to be impressed in one cycle with applied voltages higher than said threshold voltage includes each frame, thereby to cause the picture elements to effect gradation display of a number of different brightnesses in multi-stages and wherein the number of said plural number of frames per drive cycle do not correspond to said number of different brightnesses.

2. A method as in claim 1 wherein said different amplitude signals are applied in the respective frames and said voltage applied to said picture elements is equivalent to the difference between said applied modulation voltages and said writing voltages.

3. A method as in claim 2 wherein said writing voltages are Vw1 or −Vw2, said modulation voltages are OV, a voltage of a set amplitude greater than OV and less than $V_M$, $V_M$, $Vw1=Vw2+V_M$, and said threshold voltage is greater than or equal to Vw2 but less than or equal to Vw1.

4. A method as in claim 3 wherein said picture elements are caused to effect gradation display in three or more levels of brightness.

5. A method of cyclically driving a display device, said device including plural scanning side electrodes, plural data side electrodes disposed in directions intersecting said scanning side electrodes, a dielectric layer means interposed between said scanning side and said data side electrodes, and picture elements composed of said dielectric layer means interposed between said scanning side and said data side electrodes for emitting light in response to an applied voltage which is higher than or equal to a threshold voltage $V_{th}$, said method comprising:

applying plural frames of modulation voltages OV, a voltage of a set amplitude greater than OV and less than $V_M$, or $V_M$ to said data side electrodes for each driving cycle, wherein said modulation voltages are different in amplitude in each of said plural frames and correspond to the display data;

applying plural frames of positive or negative writing voltages, Vw1 or −Vw2 respectively, to said scanning side electrodes, wherein $Vw1=Vw2+V_M$ and $V_{th}$ is greater than or equal to Vw2 but less than or equal to Vw1, whereby said picture elements are caused to obtain gradation display of at least three brightness levels by applying plural frames of modulation and writing voltages for each drive cycle that are each lesser in number than the number of brightness levels obtained.

* * * * *